US011713613B2

(12) United States Patent
Neander et al.

(10) Patent No.: US 11,713,613 B2
(45) Date of Patent: Aug. 1, 2023

(54) CORNER CONNECTOR FOR INSULATING GLAZING UNITS WITH AN ELECTRICAL SUPPLY LINE

(71) Applicant: SAINT-GOBAIN GLASS FRANCE, Courbevoie (FR)

(72) Inventors: Marcus Neander, Eschweiler (DE); Guenael Morvan, Marseilles (FR); Christopher Marjan, Aachen (DE)

(73) Assignee: SAINT-GOBAIN GLASS FRANCE, Courbevoie (FR)

( * ) Notice: Subject to any disclaimer, the term of this patent is extended or adjusted under 35 U.S.C. 154(b) by 0 days.

(21) Appl. No.: 16/972,287

(22) PCT Filed: May 21, 2019

(86) PCT No.: PCT/EP2019/063083
§ 371 (c)(1),
(2) Date: Dec. 4, 2020

(87) PCT Pub. No.: WO2019/233761
PCT Pub. Date: Dec. 12, 2019

(65) Prior Publication Data

US 2021/0115726 A1 Apr. 22, 2021

(30) Foreign Application Priority Data

Jun. 7, 2018 (EP) ..... 18176419

(51) Int. Cl.
*E06B 3/667* (2006.01)
*E06B 3/663* (2006.01)
(Continued)

(52) U.S. Cl.
CPC ..... *E06B 3/667* (2013.01); *E06B 3/66366* (2013.01); *E06B 3/6722* (2013.01); *E06B 3/67326* (2013.01); *E06B 2009/2464* (2013.01)

(58) Field of Classification Search
CPC .... E06B 3/667; E06B 3/66366; E06B 3/6722; E06B 3/67326; E06B 3/9641; E06B 3/9642
(Continued)

(56) References Cited

U.S. PATENT DOCUMENTS 2,173,649 A * 9/1939 Firner ..... E06B 3/667 52/800.14
3,449,551 A * 6/1969 Aisanich ..... H05B 1/0236 219/203
(Continued)

FOREIGN PATENT DOCUMENTS

DE 4024143 A1 * 2/1992 ..... E06B 3/677
DE 93 13 394 U1 10/1993
(Continued)

OTHER PUBLICATIONS

International Search Report as issued in International Patent Application No. PCT/EP2019/063083, dated Jun. 26, 2019.

*Primary Examiner* — Brian D Mattei
*Assistant Examiner* — Joseph J. Sadlon
(74) *Attorney, Agent, or Firm* — Pillsbury Winthrop Shaw Pittman LLP

(57) ABSTRACT

A corner connector for connecting two hollow profile spacers of insulating glazing units, includes a first leg and a second leg, which are connected to one another via a corner region, and a first electrical supply line, wherein the first leg and the second leg enclose an angle α, where 45°<α<120°, the first leg, the second leg, and the corner region are formed in one piece, at least the corner region surrounds the first electrical supply line, and the first electrical supply line protrudes out of the corner region.

12 Claims, 6 Drawing Sheets

Figure 2A:
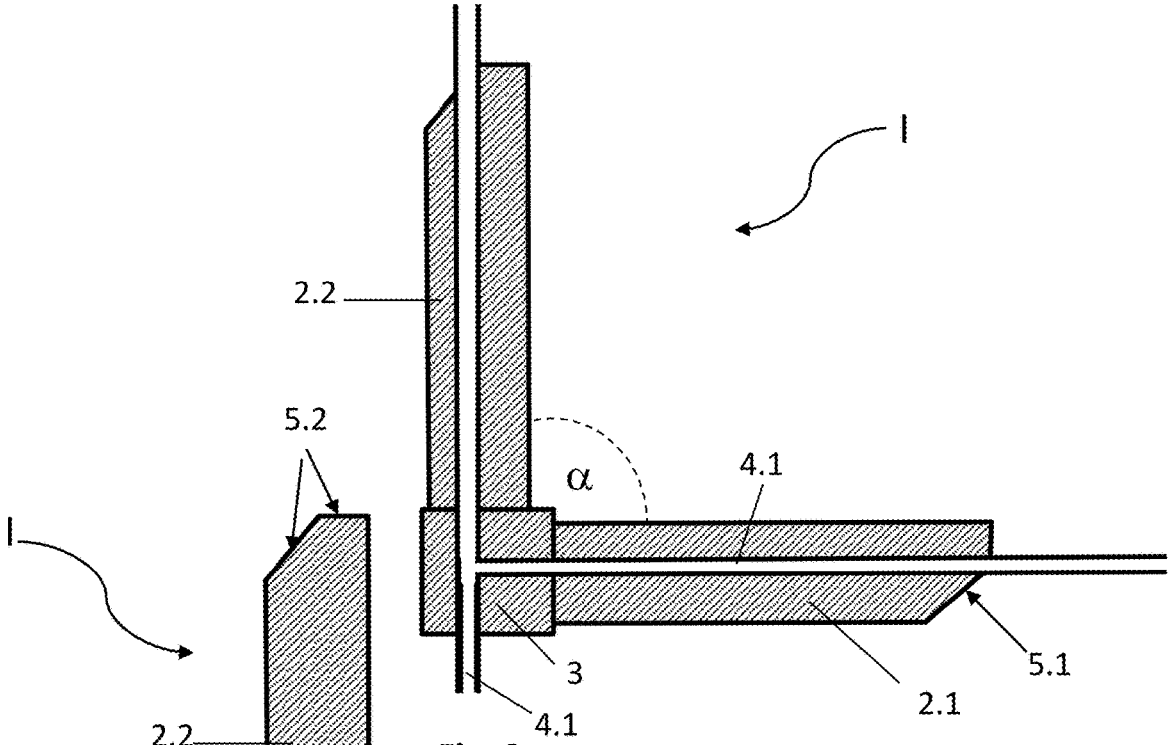

(51) Int. Cl.
*E06B 3/67* (2006.01)
*E06B 3/673* (2006.01)
*E06B 9/24* (2006.01)

(58) Field of Classification Search
USPC ..... 52/204.593
See application file for complete search history.

(56) References Cited

U.S. PATENT DOCUMENTS 3,655,939 A * 4/1972 Stromquist ..... H05B 1/0236 219/218
3,760,157 A 9/1973 Newman et al.
3,872,198 A * 3/1975 Britton ..... E06B 3/56 264/DIG. 83
4,090,799 A * 5/1978 Crotti ..... B29C 66/21 403/231
4,294,733 A * 10/1981 Marzouki ..... C08L 63/00 525/92 K
4,296,587 A * 10/1981 Berdan ..... E06B 3/66314 403/395
4,306,140 A * 12/1981 Stromquist ..... H05B 3/84 219/214
4,471,589 A * 9/1984 Schmidlin ..... E06B 3/2605 52/204.595
4,551,364 A * 11/1985 Davies ..... B29C 70/085 428/33
4,636,105 A * 1/1987 Johansson ..... B29C 66/52431 403/403
4,691,486 A * 9/1987 Niekrasz ..... A47F 3/0434 219/547
4,702,638 A * 10/1987 Zalesak ..... A47B 95/043 403/205
4,733,504 A * 3/1988 Lindgren ..... G05D 23/24 219/522
4,848,875 A * 7/1989 Baughman ..... E06B 3/6722 349/86
5,108,526 A * 4/1992 Cornils ..... B29C 48/12 156/244.11
5,157,885 A * 10/1992 Wertitsch ..... E06B 3/9612 403/402
5,197,242 A * 3/1993 Baughman ..... E04C 2/54 428/34
5,819,499 A * 10/1998 Evason ..... E06B 3/66342 52/788.1
5,983,593 A * 11/1999 Carbary ..... E06B 3/6715 52/204.593
6,148,563 A * 11/2000 Roche ..... E05C 17/24 49/501
6,295,788 B2 * 10/2001 Reichert ..... E06B 3/66319 52/204.5
6,389,779 B1 * 5/2002 Brunnhofer ..... E06B 3/66319 52/786.13
6,701,681 B2 * 3/2004 Kim ..... E06B 5/165 359/228
7,300,166 B2 * 11/2007 Agrawal ..... B60R 1/088 359/604
8,209,922 B2 * 7/2012 Petersen ..... E06B 3/6621 52/786.13
8,240,940 B2 * 8/2012 Strohheker ..... E06B 3/667 403/205
8,393,130 B2 * 3/2013 Stubblefield ..... A47F 3/0434 52/204.593
8,643,933 B2 * 2/2014 Brown ..... G02F 1/1523 359/275
8,711,465 B2 * 4/2014 Bhatnagar ..... B32B 17/10055 359/275
8,736,938 B1 * 5/2014 Schlam ..... E06B 9/264 52/786.13
8,752,354 B2 * 6/2014 Honey ..... E06B 3/66 52/656.5
9,678,368 B2 * 6/2017 Uchiyama ..... C03C 17/40
9,728,920 B2 * 8/2017 Brown ..... E06B 3/66304
9,778,533 B2 * 10/2017 Bertolini ..... B32B 17/10036
10,125,537 B2 * 11/2018 Clarahan ..... E06B 3/66347
10,180,606 B2 * 1/2019 Mullins ..... E06B 3/42
10,368,658 B2 * 8/2019 Artwohl ..... E04B 1/803
10,385,608 B2 * 8/2019 Kanno ..... E06B 7/08
10,437,127 B2 * 10/2019 Miyazaki ..... G02F 1/155
11,307,475 B2 * 4/2022 Mathew ..... A01M 29/08
2004/0227462 A1 11/2004 Utsumi et al.
2007/0177391 A1 * 8/2007 Davis ..... F21V 33/006 362/145
2012/0026573 A1 2/2012 Collins et al.
2012/0301642 A1 * 11/2012 Roberts ..... G02B 5/008 428/404
2013/0157493 A1 * 6/2013 Brown ..... E06B 3/673 439/247
2016/0060163 A1 * 3/2016 Burrows ..... B32B 17/10467 428/34
2016/0138326 A1 5/2016 Kuster et al.
2018/0224689 A1 * 8/2018 DeMiglio ..... C03C 17/23
2019/0010751 A1 * 1/2019 Mazuir ..... E06B 3/66376
2019/0064626 A1 * 2/2019 Zhu ..... G02F 1/172

FOREIGN PATENT DOCUMENTS

DE 42 35 063 A1 4/1994
DE 20 2004 019 286 U1 4/2006
DE 10 2008 026339 A1 12/2009
DE 102008026339 A1 * 12/2009 ..... B32B 17/10036
EP 0 876 608 B1 4/2002
EP 1 862 849 A1 12/2007
JP S52-006248 U 1/1977
JP S59-028527 U 2/1984
JP 2016-526622 A 9/2016
WO WO 2010/112789 A2 10/2010
WO WO 2010/147494 A1 12/2010
WO WO 2011/033313 A1 3/2011
WO WO 2012/007334 A1 1/2012
WO WO 2013/184321 A2 12/2013
WO WO 2014/032023 A1 2/2014
WO WO 2014/198431 A1 12/2014
WO WO 2016/098837 A1 6/2016
WO WO-2016098837 A1 * 6/2016 ..... C03C 27/06
WO WO 2017/106458 A1 6/2017

* cited by examiner

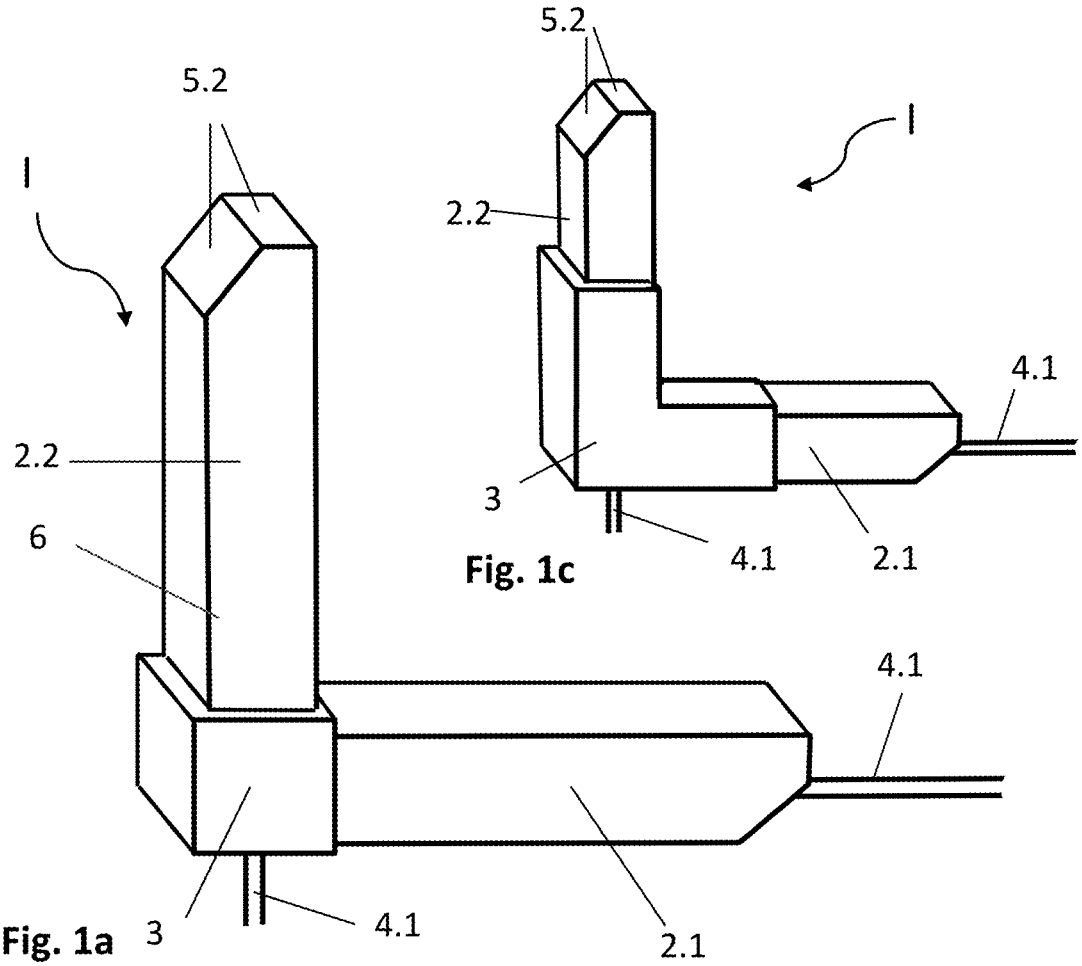
Fig. 1a
Fig. 1c
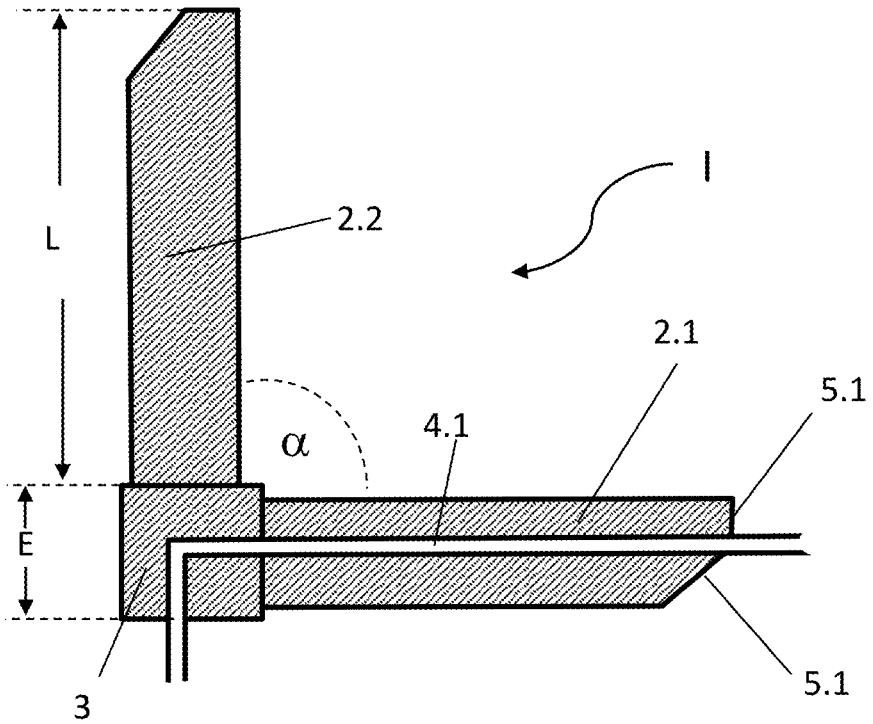
Fig. 1b

CORNER CONNECTOR FOR INSULATING GLAZING UNITS WITH AN ELECTRICAL SUPPLY LINE

CROSS-REFERENCE TO RELATED APPLICATIONS

This application is the U.S. National Stage of PCT/EP2019/063083, filed May 21, 2019, which in turn claims priority to European patent application number 18176419.2 filed Jun. 7, 2018. The content of these applications are incorporated herein by reference in their entireties.

The invention relates to a corner connector with an integrated electrical supply line, an insulating glazing unit including such a corner connector, and use thereof.

Insulating glazing units have become indispensable in building construction, especially in the wake of ever stricter environmental protection regulations. These are made of at least two panes that are joined to one another via at least one circumferential spacer frame. The spacer frame usually consists of a spacer profile that is joined at at least one point. The connection can be done, for example, by welding or using plug connectors. Depending on the embodiment, the space between the two panes, referred to as the glazing interior, is air- or gas-filled, but free, in any case, of moisture. Excessive moisture content in the glazing interpane space results, in particular with cold outside temperatures, in condensation of water droplets in the interpane space, which must absolutely be avoided. To absorb the residual moisture remaining in the system after assembly, desiccant-filled hollow-body spacers can be used. However, since the absorption capacity of the desiccant is limited, sealing of the system is also of enormous importance to prevent penetration of further moisture.

Beyond their basic function, insulating glazing units can also contain further elements in the form of built-in components or panes with controllable additional functions. Glazings with switchable or controllable optical properties are one type of modern, active glazings. With such glazings, for example, the transmittance of light can be actively influenced as a function of an applied electrical voltage. The user can, for example, switch from a transparent to a non-transparent state of the glazing to prevent vision into the room from the outside. With other glazings, the transmittance can be infinitely adjusted, for example, to regulate the entry of solar energy into a room. Thus, undesirable heating of buildings or vehicle interiors is avoided and the energy consumption or $CO_2$ emissions caused by air conditioning systems are reduced. Consequently, active glazings are used not only for the visually appealing designing of façades and pleasant lighting in the interior, but are also advantageous from an energy and ecology standpoint.

Active glazings contain a functional element, which typically contains an active layer between two surface electrodes. The optical properties of the active layer can be changed by a voltage applied to the surface electrodes. Electrochromic functional elements, known, for example, from US 20120026573 A1 and WO 2012007334 A1 are an example of this. SPD functional elements (suspended particle device), known, for example, from EP 0876608 B1 and WO 2011033313 A1 are another example. The transmittance of visible light through electrochromic or SPD functional elements can be controlled by the voltage applied. The voltage feed is done via so-called busbars, which are usually applied to the surface electrodes and are connected to a voltage source via suitable connection cables.

When an active glazing is integrated in an insulating glazing, the voltage feed of the active glazing must be designed gas- and water-tight in order to ensure sufficient quality and service life of the insulating glazing. In WO 2017/106458 A1, the electrical supply line itself is designed in shape and size such that it has high tolerance against relative movements with differing thermal expansion of the components involved. However, the supply line itself is made between the spacer and an adjacent pane through the primary sealant used for bonding and sealing. Such a passage of cable through the edge seal of the insulating glazing always also constitutes a potential defect site.

Moreover, in practice, electrical contact is often necessary at multiple locations of the insulating glazing. According to the prior art, the connection cable is routed around the spacer frame in the outer interpane space. The spacer is bonded to the panes of the insulating glazing via a so-called primary sealant, whereas a secondary sealant is introduced into the outer interpane space, filling it and surrounding any electrical connection cables that may be present. However, automated filling of the outer interpane space in the presence of electrical connection cables has proved problematic since they can, for example, spatially obstruct a robot arm with an extrusion nozzle. Furthermore, there must be no air bubbles remaining in the outer interpane space, for example, between the connection cable and the spacer. The volume of the enclosed air varies with changing climatic conditions and permanently results in leaks of the insulating glazing in the region of the air inclusion.

WO2013184321A2 discloses a possibility for routing a cable into the glazing interior without the cable having to be routed through the primary sealant. Here, the cables are routed into the glazing interior through an insulating element, for example, in the form of longitudinal connectors. However, this method does not solve the problem that connection cables have to be guided around the insulating glazing unit in the outer interpane space such that contact can be made with different points in the insulating glazing unit. Precisely in the corner region, the routing is particularly critical since, there, automated sealing is particularly difficult and the cables are particularly susceptible to mechanical damage.

The object of the present invention is to provide a corner connector that enables production of an improved insulating glazing unit and to provide an improved insulating glazing unit having such a corner connector.

The object of the present invention is accomplished according to the invention by a corner connector in accordance with the independent claim 1 and the further independent claims for an insulating glazing unit having a spacer and for its use. Preferred embodiments of the invention are apparent from the dependent claims.

The corner connector according to the invention for connecting two hollow profile spacers of insulating glazing units comprises at least a first leg and a second leg, which are connected to one another via a corner region. The first leg, the second leg, and the corner region are formed in one piece, i.e., they are in one piece and are not connected to one another via reversible plug connections. This design is particularly stable. The first leg and the second leg enclose an angle $\alpha$, where $45° < \alpha < 120°$. The corner region includes at least a first electrical supply line, i.e., the first electrical supply line is integrated into the corner region. In a first preferred embodiment, the first electrical supply line protrudes out of the corner region. This means that the first electrical supply line protrudes out of the region of the corner connector that points toward the glazing interior in the finished insulating glazing unit, and/or protrudes out of the region that points toward the outer interpane space. Introduction of the electrical supply line into the glazing interior is thus made significantly easier and, at the same time, enables it to also be routed out. In another preferred embodiment, a first electrical supply line that protrudes out of the first leg is arranged at least in the first leg and in the corner region. Preferably, the electrical supply line is arranged such that it protrudes only out of the first leg and out of the corner region. According to the invention, the leg is the region of the corner connector that is inserted into a hollow space of a hollow profile spacer in the finished insulating glazing unit. Thus, this enables the electrical supply line to be continued farther, in particular, into the interior of a hollow profile spacer. From there, it can be routed farther via openings in the hollow profile spacer into the glazing interior or into the outer interpane space. Alternatively, contact can be made with an electrical element that is arranged in the interior of the hollow profile spacer.

Thus, the corner connector according to the invention offers the possibility of integrating an electrical supply line into an insulating glazing unit in a simple manner, wherein the sealing of the edge seal in the region of the primary sealant is not damaged. In the prior art, electrical supply lines have, until now, been guided into the glazing interior within the primary sealant that bonds the spacer frame to the outer panes. Any cable passageway constitutes a potential leak since cavities can remain in the vicinity of the cable, resulting in a leak due to thermal expansion of the air contained. Integration into the corner region is particularly advantageous, as the electrical supply line is thus contained in a protected manner in the corner connector and does not have to be routed around the corner in the outer interpane space. In addition, no support blocks between the insulating glazing unit and the window frame are incorporated into a window in the region of the corner. Direct contacting of an electrical functional element via the first electrical supply line in the corner region is possible, as is contacting of an electrical element, such as an electrical conductor, in the interior of a hollow profile spacer and/or contacting of an external voltage source. A substantial advantage of the invention also resides in the high degree of prefabrication of the corner connectors according to the invention having an integrated electrical supply line. The lines are already integrated into the corner connector during the production process of the corner connector such that during production of the insulating glazing unit, manual installation of the lines is no longer required. During production of the insulating glazing unit, the supply lines already present in the main body of the corner connector only have to be connected to the electrical loads provided or to a voltage source.

In a preferred embodiment, the first electrical supply line enters the corner region via an entry opening from the side of the corner connector that faces the outer interpane space in the finished insulating glazing unit and exits again via an exit opening in the corner region in the direction of the glazing interior. Thus, an electrical supply line can be introduced directly into the glazing interior, with the production of the hollow profile spacer being possible as usual. The integration and sealing of the electrical supply line in the main body of the corner connector can be carried out separately. Also, no additional sealing points in the spacer frame are necessary.

In another preferred embodiment, the first electrical supply line protrudes out of the first leg and out of the corner region. Preferably, the first electrical supply line enters the corner region through an entry opening and exits again via an exit opening in the direction of the hollow space of the hollow profile spacer. Thus, contact of an electrical element in the hollow space in the hollow profile spacer with an external voltage source can be established very easily. Alternatively, or additionally, the first electrical supply line preferably exits through an exit opening out of the corner region into the glazing interior and through an exit opening out of the first leg in the direction of the hollow profile spacer. Thus, contact of an electrically switchable functional element in the glazing interior with an electrical element in the hollow space of the hollow profile spacer can be easily established.

In another preferred embodiment, the first electrical supply line protrudes out of the first leg and the second leg. In this case, routing of the electrical supply line within the corner connector is enabled such that no arrangement of the electrical supply line in the outer interpane space is necessary. This is, in particular, advantageous when multiple contact points of a functional element distant from one another, for example, on different sides of an insulating glazing unit must be contacted and cable routing around the corner is required. Thanks to the corner connector according to the invention, the electrical supply line is protected, and damage is prevented during the automated filling of the outer interpane space. In another possible embodiment, the first electrical supply line protrudes only out of the first leg and the second leg. This only allows a cable to be routed around the corner.

In another preferred embodiment, the corner connector includes at least a second electrical supply line. Thus, for example, different polarities can be introduced into the insulating glazing unit at different points, or multiple electrically switchable functional elements can be contacted. Particularly preferred are corner connectors with two, three, or four electrical supply lines.

In another preferred embodiment of the corner connector according to the invention, the corner connector includes a polymeric main body. This is advantageous since the thermal conductivity of plastics is significantly lower than the thermal conductivity of metals. Furthermore, the plastic of the polymeric main body has a specific resistance of at least $10^8$ Ω cm and is, consequently, non-conductive for electric current. This is particularly advantageous, since, in this case, the electrical supply line requires no further insulation and the polymeric main body insulates the electrical supply line sufficiently relative to other components. In the case of an insulating glazing unit with metallic spacers, the polymeric main body also acts as an insulator between the metallic electrically conductive sections of the spacer.

Optionally, the polymeric main body can also have an electrical supply line with insulating sheathing surrounding the supply line. This is advantageous, for example, to insulate multiple supply lines of different polarities running in the hollow chamber relative to each other.

The polymeric main body preferably contains or is made of polyethylene (PE), polyvinyl chloride (PVC), polycarbonate (PC), polypropylene (PP), polystyrene, polybutadiene, polynitriles, polyesters, polyurethanes, polymethyl methacrylates, polyacrylates, polyamides, polyethylene terephthalate (PET), polybutylene terephthalate (PBT), preferably acrylonitrile butadiene styrene (ABS), acrylonitrile styrene acrylester (ASA), acrylonitrile butadiene styrene/polycarbonate (ABS/PC), styrene acrylonitrile (SAN), PET/PC, PBT/PC, and/or mixtures thereof. Particularly good results are achieved with these materials.

In another preferred embodiment of the invention, the main body is a metallic main body. The metallic main body is preferably made of aluminum or stainless steel. With metallic main bodies, the electrical supply line is surrounded by insulating sheathing that prevents a short-circuit between an electrical supply line and the electrically conductive metallic main body.

The insulating sheathing has specific resistance greater than or equal to $10^8$ Ω cm and preferably includes polyvinyl chloride, polyethylene, rubber, and/or polyurethane.

In an alternative embodiment of the corner connector according to the invention, at least one leg of the corner connector is connected to the rest of the corner connector via a reversible plug connection. The corner connector is thus implemented in at least two parts. This design is particularly flexible and can be combined with all other preferred variants. The corner connector is particularly preferably implemented in three parts. In this case, the two legs of the corner connector are joined to the corner region via a reversible plug connection. The corner region is preferably a bent piece of a hollow profile spacers that is subsequently provided with two longitudinal connectors. A longitudinal connector includes two insertion legs, the first of which is inserted into the corner region and the second insertion leg forms one leg of the corner connector.

The electrical supply line is an electrical conductor, preferably containing copper. Other electrically conductive materials can also be used. Examples for this are aluminum, gold, silver, or tin and alloys thereof. The electrical supply line can be designed both as a flat conductor and as a round conductor and, in both cases, as a single wire or multi-wire conductor (stranded wire).

The electrical supply line preferably has a conductor cross-section of 0.08 $mm^2$ to 2.5 $mm^2$.

Foil conductors can also be used as a supply line. Examples of foil conductors are described in DE 42 35 063 A1, DE 20 2004 019 286 U1, and DE 93 13 394 U1.

Flexible foil conductors, sometimes also called "flat conductors" or "flat band conductors", are preferably made of a tinned copper strip with a thickness from 0.03 mm to 0.1 mm and a width from 2 mm to 16 mm. Copper has proven successful for such conductor tracks since it has good electrical conductivity as well as good processability into foils. At the same time, material costs are low.

In a preferred embodiment, the corner connector includes a polymeric main body, into which the electrical supply line is already inserted during extrusion of the corner connector. The main body is extruded around the electrical supply line. This is particularly advantageous in terms of simple and economical production of the corner connector and automated integration of the supply line into the main body. Alternatively, the corner connector is preferably produced by injection molding, wherein the electrical supply line can also be introduced into the injection mold during the process.

In another preferred embodiment, the main body of the corner connector is provided with at least one opening, for example, with a drilled hole, through which the supply lines are drawn into the corner connector. Since manual installation of the supply lines during production of the insulating glazing unit is eliminated, the degree of automation of insulating glazing production can be further increased.

According to the invention, the first electrical supply line protrudes out of the corner region or the legs. This means that the electrical supply line extends beyond the main body of the corner connector at the entry or exit point far enough that electrically conductive contact or connection of an electrical element, an electrically switchable functional element, or a voltage source is possible. In the context of the invention, "electrically conductively contacted" means, in particular, conductively connected capacitively or preferably galvanically. When using a flat conductor, it suffices for the flat conductor to be exposed at the surface of the corner connector. An electrically conductive connection can be established by insertion into a hollow space of a hollow profile spacer that has such an electrical element, such as a flat conductor. When using a cable as an electrical supply line, the length of the cable is preferably dimensioned such that the cable is longer than the part that is integrated into the corner connector.

The electrical supply line is suitable for being connected to a voltage supply at one end and to contact an electrical load at another end. After mounting of the corner connector according to the invention in an insulating glazing, the voltage supply is preferably positioned outside the glazing interior; and the electrical load, within the glazing interior. Alternatively, preferably, the voltage source is situated in the glazing interior; and the electrical load, outside the glazing interior. This embodiment can, for example, be realized in the case of a photovoltaic element integrated in the insulating glass as a voltage source.

The connection of the electrical supply line to a load or to a voltage supply can be done in various ways known to the person skilled in the art. Contacting is possible using detachable electrical connections, such as spring contacts, plug connectors, luster terminals; conditionally detachable connections, such as soldering; or non-detachable electrical connections, such as crimp connections, welding, gluing, crimping. Particularly preferably, the electrical supply line is equipped for establishing a plug connection at at least one end. This enables simple connection of an electrical load or a voltage supply that is equipped with an appropriate counterpart. Particularly preferred are magnetic plugs, as they enable a particularly simple connection.

In the context of the invention, an "electrical element" refers to an electrical element that is arranged in the interior of the hollow profile spacer in the finished insulating glazing unit and that is electrically conductively connectable to the electrical supply line of the corner connector. This can be another electrical conductor in the form of a cable or film conductor or, for example, a part of a plug connector.

Another aspect of the invention is an insulating glazing unit including a corner connector according to the invention. The insulating glazing unit comprises at least a first pane, a second pane, and a spacer frame arranged between the panes. The spacer frame comprises at least one hollow profile spacer and at least one corner connector according to the invention. The first pane and the second pane are joined in a leakproof manner to the spacer frame via a primary sealant such that a sealed glazing interior is created. Situated between the first pane, the second pane, and the spacer frame, on the side of the spacer frame that faces the external environment, is an outer interpane space, in which a secondary sealant is arranged. The secondary sealant contributes to the mechanical stability of the insulating glazing unit. The corner connector according to the invention includes a first electrical supply line, which enters the glazing interior through an exit opening in the spacer frame. Preferably, the first electrical supply line electrically conductively contacts an electrically switchable functional element in the glazing interior, with the first electrical supply line exclusively protruding through the secondary sealant. In other words, the first electrical supply line does not pass through the primary sealant. I.e., in this way, it is possible to provide an electrical connection of an electrically switchable functional element with an external power source without the first electrical supply line adversely affecting the tightness of the edge seal.

In a preferred embodiment of the insulating glazing unit, the exit opening is situated in the corner region of the corner connector. Thus, no opening has to be made in a hollow profile spacer and sealed with great effort; instead, the electrical supply line can be introduced into the insulating glazing unit via the prefabricated corner connector without major manufacturing effort.

In an alternative preferred embodiment, the exit opening is situated in a section of the hollow profile spacer. In this case, the first electrical supply line can be routed to an electrically switchable functional element at any desired location. This is, in particular, advantageous with larger insulating glazing units.

In a preferred embodiment, the first electrical supply line enters the corner connector in the corner region of the corner connector and protrudes through the secondary sealant only in the region of the corner connector. The electrical supply line preferably does not extend over longer sections along the spacer in the outer interpane space, but, rather, is routed directly out of the insulating glazing unit out of the corner connector over the shortest distance through the secondary sealant. This prevents the electrical supply line from being positioned in the outer interpane space over longer sections and having to be protected during filling with a secondary sealant.

In another preferred embodiment, the first electrical supply line protrudes out of the first leg and enters a hollow chamber of the hollow profile spacer. The first electrical supply line can thus be guided through the hollow chamber of the hollow profile spacer to a location where an electrically switchable functional element is to be contacted without having to be guided through the secondary sealant over long distances.

In another preferred embodiment of the insulating glazing unit according to the invention, the electrically switchable functional element comprises a first conductor surface and a separate second conductor surface separated therefrom. The first conductor surface is connected to the first electrical supply line, and the second conductor surface is connected to the second electrical supply line. The first electrical supply line protrudes out of the first leg and enters a hollow chamber of the hollow profile spacer. The second supply line protrudes out of the second leg and also enters a hollow chamber of the hollow profile spacer. Preferably, both electrical supply lines enter the corner region of the same corner connector. Thus, insertion of an electrical supply line is necessary at only one point of the insulating glazing unit according to the invention and conductor surfaces are contacted at two different points. In another preferred embodiment, the first electrical supply line includes a plurality of wires. A first wire is connected to the first conductor surface and a second wire is connected to the second conductor surface. The first electrical supply line preferably enters the corner region of the corner connector, branches there, and the first wire protrudes out of the first leg and the second wire protrudes out of the second leg.

Another aspect of the invention is a double corner connector comprising two corner connectors according to the invention, as described above, which are joined to one another in the corner region via a web. Such a corner connector is suitable for a double spacer that consists of two hollow profile strips connected to one another via a web. Such double spacers are suitable for producing triple glazing units with two separated glazing interiors. A double corner connector offers the possibility of servicing both or, alternatively, only one glazing interior with an electrical supply line.

Preferably, the web of the double corner connector is implemented such that a groove is formed for receiving a third pane. A pane with an electrically switchable functional element can, for example, be inserted into this groove. The dimensions of this groove must match those of the double spacer used such that the third pane is circumferentially positioned along the entire spacer frame.

In a preferred embodiment, the first electrical supply line enters the groove through an exit opening. This means that the first electrical supply line protrudes out of the groove on the side of the corner connector that faces in the direction of the glazing interior in the finished insulating glazing unit. Thus, an electrically switchable functional element that is arranged on the pane inserted into the groove can be contacted via the electrical supply line.

Another aspect of the invention is an insulating glazing unit with a double corner connector as described. The insulating glazing unit includes at least a first pane, a second pane, and a third pane. Between the first pane and the second pane, a spacer frame that includes at least one double spacer and one double corner connector according to the invention is circumferentially arranged. The first pane and the second pane are in each case bonded to the spacer frame via a primary sealant, forming a sealed glazing interior. The spacer frame has a circumferential groove, into which the third pane is inserted. The third pane divides the sealed glazing interior into a first glazing interior between the first and the third pane and a second glazing interior between the third and the second pane. The circumferential groove of the spacer frame is formed by the groove in the double spacer and the groove of the double corner connector. The third pane includes an electrically switchable functional element that makes electrically conductive contact via the electrical supply line. Preferably, the contact is made within the groove. This improves the optical appearance of the insulating glazing unit since the contacting is not visible from the outside. Preferably, the first electrical supply line protrudes exclusively through the secondary sealant. In other words, the first electrical supply line is not passed through the primary sealant. In other words, in this way, an electrical connection of an electrically switchable functional element to an external power source can be established without the first electrical supply line adversely affecting the tightness of the edge seal.

The above-described possibilities for routing the electrical supply line through an exit opening into the glazing interior into the corner connector apply by analogy to the embodiment of the insulating glazing unit with a double corner connector.

In the case of the spacer frame with a double spacer and double corner connector, there is an additional possibility for positioning an exit opening of the electrical supply line. The exit opening can be positioned within the groove. Preferably, the exit opening through which the first electrical supply line enters the glazing interior is positioned in the groove of the double corner connector.

A double spacer that can be used for the insulating glazing unit according to the invention is disclosed, for example, in WO 2014198431 A1. The double spacer comprises a main body with a first pane contact surface and a second pane contact surface extending parallel thereto, a glazing interior surface, and an outer surface. The glazing interior surface is subdivided by the groove into two sub-regions. A first hollow chamber and a second hollow chamber that are separated from one another by the groove are introduced into the main body. The first hollow chamber is adjacent a first sub-region of the glazing interior surface, while the second hollow chamber is adjacent a second sub-region of the glazing interior surface, with the glazing interior surface situated above the hollow chambers and the outer surface situated below the hollow chambers. In this context, "above" is defined as facing the pane interior of an insulating glazing with a spacer according to the invention and "below" as facing away from the pane interior. Since the groove extends between the first glazing interior surface and the second glazing interior surface, it delimits them laterally and separates the first hollow chamber and the second hollow chamber from one another. The lateral flanks of the groove are formed by the walls of the first hollow chamber and the second hollow chamber. The groove forms a depression suitable for accommodating the middle pane (third pane) of an insulating glazing. The position of the third pane is thus defined by two lateral flanks of the groove and the bottom surface of the groove. A first and a second pane can be mounted on the first and second pane contact surface of the spacer.

A double corner connector with two first legs and two second legs is also advantageous in light of the fact that electrical supply lines with different voltage potentials can be routed separately from one another in each case in one of the first or second legs and can be routed from there into two hollow chambers of a double spacer. Alternatively, even a plurality of electrical supply lines of different polarities that are surrounded by an insulating sheathing can be routed into one hollow chamber.

Another aspect of the invention is a triple corner connector including three corner connectors according to the invention, as described above that are joined to one another in the corner region via two webs that preferably form in each case a groove for receiving middle panes. Such a corner connector is suitable for connecting a triple spacer consisting of three hollow profile strips connected to one another via two webs. Such triple spacers are suitable for producing quadruple glazing units with three separated glazing interiors. A triple corner connector offers the capability of supplying three, two, or, alternatively, only one glazing interior with an electrical supply line. The individual embodiments for the single and double corner connector also apply by analogy for a triple or quadruple embodiment of a corner connector.

The following statements relate to an insulating glazing unit with a single or double corner connector.

The primary sealant preferably contains butyl rubber, polyisobutylene, polyethylene vinyl alcohol, ethylene vinyl acetate, polyolefin rubber, polypropylene, polyethylene, copolymers, and/or mixtures thereof.

The primary sealant is preferably introduced into the gap between the spacer frame and the panes with a thickness of 0.1 mm to 0.8 mm, particularly preferably 0.2 mm to 0.4 mm.

The outer interpane space of the insulating glazing unit is preferably filled with a secondary sealant. This secondary sealant serves primarily for bonding the two panes and thus for mechanical stability of the insulating glazing unit.

The secondary sealant preferably contains polysulfides, silicones, silicone rubber, polyurethanes, polyacrylates, copolymers, and/or mixtures thereof. Such materials have very good adhesion to glass such that the secondary sealant ensures secure bonding of the panes.

The thickness of the secondary sealant is preferably 2 mm to 30 mm, particularly preferably 5 mm to 10 mm.

An insulating glazing unit according to the invention can contain a plurality of electrical supply lines that run through the spacer frame parallel to one another or also in different sections of the spacer frame. Preferably, all electrical supply lines are introduced into a hollow chamber of the spacer frame at the same point from the outer interpane space through a corner connector according to the invention. This is advantageous since, thus, there is only a single entry opening and the risk of leaks in the edge seal is thus minimized.

Depending on the design of the electrically switchable functional element, there can be a plurality of electrical supply lines of different polarity that make contact with the electrically switchable functional element at different positions.

The actual functional element having electrically switchable optical properties is formed at least by two electrically conductive layers and one active layer. The electrically conductive layers form surface electrodes. By applying a voltage to the surface electrodes, or by changing the voltage applied to the surface electrodes, the optical properties of the active layer, in particular the transmittance and/or the scattering of visible light can be influenced.

The electrically conductive layers are preferably transparent. The electrically conductive layers preferably contain at least a metal, a metal alloy, or a transparent conductive oxide (TOO). The electrically conductive layers preferably contain at least one transparent conductive oxide.

The electrically conductive layers preferably have a thickness of 10 nm to 2 μm, particularly preferably of 20 nm to 1 μm, most particularly preferably of 30 nm to 500 nm, and in particular of 50 nm to 200 nm. Thus, advantageous electrical contacting of the active layer is achieved.

The electrically conductive layers are intended to be electrically conductively connected to at least one external voltage source in order to serve as surface electrodes of the switchable functional element.

The actual switchable functional element can, in principle, be any functional element having electrically switchable properties known per se to the person skilled in the art. The design of the active layer depends on the type of functional element.

In an advantageous embodiment of the invention, an electrochromic functional element is contained in the glazing interior. Here, the active layer of the multilayer film is an electrochemically active layer. The transmittance of visible light depends on the rate of ion storage in the active layer, with the ions provided, for example, by an ion storage layer between an active layer and a surface electrode. Transmittance can be influenced by the voltage applied to the surface electrodes, which causes a migration of the ions. Suitable active layers contain, for example, at least tungsten oxide or vanadium oxide. Electrochromic functional elements are known, for example, from WO 2012007334 A1, US 20120026573 A1, WO 2010147494 A1, and EP 1862849 A1.

In another advantageous embodiment of the invention, a PDLC functional element (polymer dispersed liquid crystal) is placed in the glazing interior. The active layer contains liquid crystals that are, for example, embedded in a polymer matrix. When no voltage is applied to the surface electrodes, the liquid crystals are randomly oriented, resulting in strong scattering of the light passing through the active layer. When a voltage is applied to the surface electrodes, the liquid crystals align themselves in one common direction and the transmittance of light through the active layer is increased. Such a functional element is known, for example, from DE 102008026339 A1.

In another advantageous embodiment of the invention, the insulating glazing contains an electroluminescent functional element in the inner interpane space. The active layer contains electroluminescent materials that can be inorganic or organic (OLED). Applying a voltage on the surface electrodes excites the luminescence of the active layer. Such functional elements are known, for example, from US 2004227462 A1 and WO 2010112789 A2.

In another advantageous embodiment of the invention, the electrically switchable functional element is an SPD functional element (suspended particle device). The active layer contains suspended particles that are preferably embedded in a viscous matrix. The absorption of light by the active layer can be varied by applying a voltage on the surface electrodes, which results in a change in orientation of the suspended particles. Such functional elements are known, for example, from EP 0876608 B1 and WO 2011033313 A1.

In addition to the active layer and the electrically conductive layers, the electrically switchable functional element can, of course, have other layers known per se, for example, barrier layers, blocking layers, anti-reflection or reflection layers, protective layers, and/or smoothing layers.

The electrically switchable functional element can, alternatively, also include an electrically heatable coating, a photovoltaic coating integrated into the insulating glazing, and/or a thin-film transistor-based liquid crystal display (TFT-based LCD).

The electrically switchable functional element can be arranged at any desired point within the glazing interior. Preferably, the electrically switchable functional element is situated on one of the surfaces of the panes of the insulating glazing unit situated in the glazing interior.

In the case of a double glazing, the electrically switchable functional element is preferably attached to the surface of the first pane and/or the second pane facing the glazing interior.

Particularly preferably, the insulating glazing unit according to the invention is a triple or multiple insulating glazing unit. In this case, the electrically switchable functional element is preferably applied on the third pane or additional other panes that are arranged between the first pane and the second pane.

The electrical connection of the supply line and the electrically conductive layers of the functional element is preferably done by so-called busbars, for example, strips of an electrically conductive material or electrically conductive imprints to which the electrically conductive layers are connected. The busbars are used to transfer electrical power and enable homogeneous voltage distribution. The busbars are advantageously produced by printing a conductive paste. The conductive paste preferably contains silver particles and glass frits. The layer thickness of the conductive paste is preferably from 5 μm to 20 μm.

In an alternative embodiment, thin and narrow metal foil strips or metal wires that preferably contain copper and/or aluminum are used as busbars; in particular, copper foil strips with a thickness of approx. 50 μm are used. The width of the copper foil strips is preferably 1 mm to 10 mm. The electrical contact between an electrically conductive layer of the functional element serving as a surface electrode and the busbar can be established, for example, by soldering or by gluing with an electrically conductive adhesive.

In an advantageous embodiment of the invention, a third pane having an electrically switchable functional element is inserted into the groove of a spacer frame with a double spacer and a double corner connector, with a busbar printed along the pane edge of the third pane. The busbar is dimensioned such that, after insertion of the pane into the groove of the spacer frame, the busbar is completely concealed by the groove. Accordingly, the height of the busbar, measured perpendicular to the nearest pane edge, is the height of the groove of the spacer frame minus the distance between the busbar and the nearest pane edge. Preferably, the groove has a height of 3 mm to 10 mm, particularly preferably 3 mm to 6 mm, for example, 5 mm, and the height of the busbar is 2 mm to 9 mm, preferably 2 mm to 5 mm. The distance from the busbar to the nearest pane edge is, for example, 1 mm.

Thus, even when using busbars, it is possible to make contact that is within the groove and invisible to the observer. Alternatively, the busbar can still be positioned in the visible region of the pane and can be as far from the nearest pane edge as desired. Optionally, the busbar can be concealed by decorative elements, for example, a screen print.

Electrical contacting between an electrical supply line and a busbar can either be indirect via contact elements or direct. Contact elements are used to achieve the best possible connection to the busbar in terms of mechanical stability of the connection and minimization of an undesirable voltage drop. Suitable means for electrically conductively fixing the contact element to the busbar are known to the person skilled in the art, for example, by soldering or gluing by means of a conductive adhesive.

Preferably, the contact element is implemented as a spring contact. This is particularly advantageous since this way there is a reversible connection of the contact element and the busbar, and the electrical contact between the contact element and the busbar is already made immediately upon insertion of the pane carrying the busbar into the groove of the spacer frame.

The first pane, the second pane, and/or the third pane of the insulating glazing preferably contain glass, particularly preferably quartz glass, borosilicate glass, soda lime glass, and/or mixtures thereof. The first and/or second pane of the insulating glazing can also include thermoplastic polymeric panes. Thermoplastic polymeric panes preferably include polycarbonate, polymethyl methacrylate, and/or copolymers and/or mixtures thereof. Additional panes of the insulating glazing can have the same composition as mentioned for the first, second, and third pane.

The first pane and the second pane have a thickness of 2 mm to 50 mm, preferably 2 mm to 10 mm, particularly preferably 4 mm to 6 mm, with the two panes possibly even having different thicknesses.

The first pane, the second pane, and other panes can be made of single-pane safety glass, thermally or chemically toughened glass, float glass, extra-clear low-iron float glass, colored glass, or laminated safety glass including one or more of these components. The panes can have any other components or coatings desired, for example, low-E layers or other solar protection coatings.

The outer interpane space, delimited by the first pane, the second pane, and the outer surface of the spacer frame, is filled at least partially, preferably completely, with a secondary sealant. Very good mechanical stabilization of the edge seal is thus achieved.

The insulating glazing is optionally filled with a protective gas, preferably with a noble gas, preferably argon or krypton, which reduce the heat transfer value in the insulating glazing interior.

In principle, a wide variety of geometries of the insulating glazing unit are possible, for example, rectangular, trapezoidal, and rounded shapes.

The invention further includes a method for producing an insulating glazing unit according to the invention comprising the steps:

a) Providing a corner connector with an integrated electrical supply line,
b) Assembling a spacer frame from hollow profile spacers and corner connectors,
c) Attaching the spacer frame between a first pane and a second pane by means of a primary sealant and introducing an electrically switchable functional element into the glazing interior,
d) Pressing the pane assembly,
e) Introducing a secondary sealant in the outer interpane space.

In step c), the electrical supply line makes electrically conductive contact with the electrically switchable functional element. For this, a section of the electrical supply line is routed out of the corner connector or the hollow profile spacer via an exit opening. Depending on its positioning, the exit opening can be produced during step step b) or before step b). When the opening is arranged in the hollow profile spacer, it is preferably made in the form of a drilled hole in the main body of the spacer. Preferably, the exit opening is situated in the corner connector according to the invention and is already integrated therein during its production.

The electrically switchable functional element is introduced into the glazing interior at the same time as the attaching of the panes in step c) since it is usually attached on one of the surfaces of the panes located in the interior of the insulating glazing unit after assembly.

The bonding of the panes per step c) can be carried out in any order desired. Optionally, the bonding of the two panes to the pane contact surfaces can also be done simultaneously.

In step e), the outer interpane space is at least partially, preferably completely, filled with a secondary sealant. The secondary sealant is preferably extruded directly into the outer interpane space, for example, in the form of a plastic sealing compound.

Preferably, the glazing interior between the panes is filled with a protective gas before the pressing of the assembly (step d)).

Preferably, before step c), a desiccant is filled into the hollow chamber via the open cross-section of the spacer.

If the glazing to be produced is a multiple glazing with a double spacer including at least one groove, at least a third pane is inserted into the groove of the spacer frame before step c).

The invention further includes the use of a corner connector or a double corner connector according to the invention in insulating glazing units including electrically switchable functional elements, particularly preferably in double or triple insulating glazing units, in particular in double or triple insulating glazing units including an SPD, a PDLC, an electrochromic, or an electroluminescent functional element. In all these glazings having electrically switchable components, a voltage supply into the glazing interior is necessary such that an electrical supply line has to be routed from the outer interpane space into the glazing interior, which is significantly improved by the use of the corner connector according to the invention. The invention further includes the use of a corner connector or a double connector according to the invention having a photovoltaic element. In this case the power supply is provided by the photovoltaic element and contact is made with an electrical load outside the glazing interior via an electrical supply line.

Figure 2B:
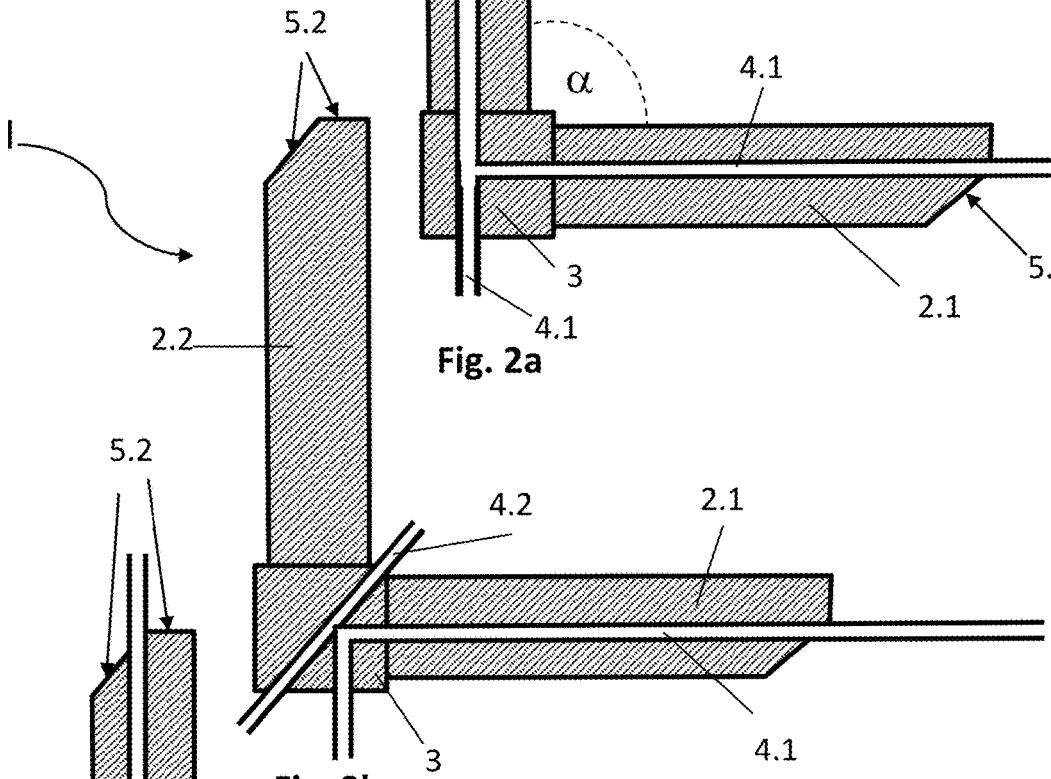
Figure 2C:
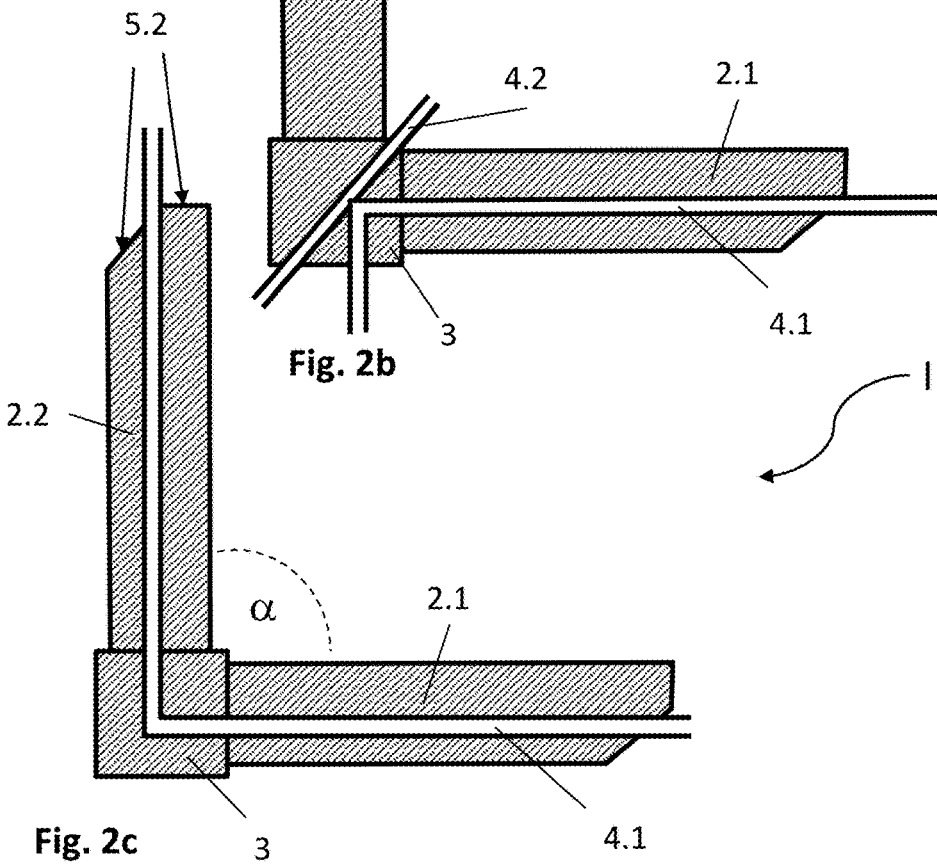
Figure 3A:
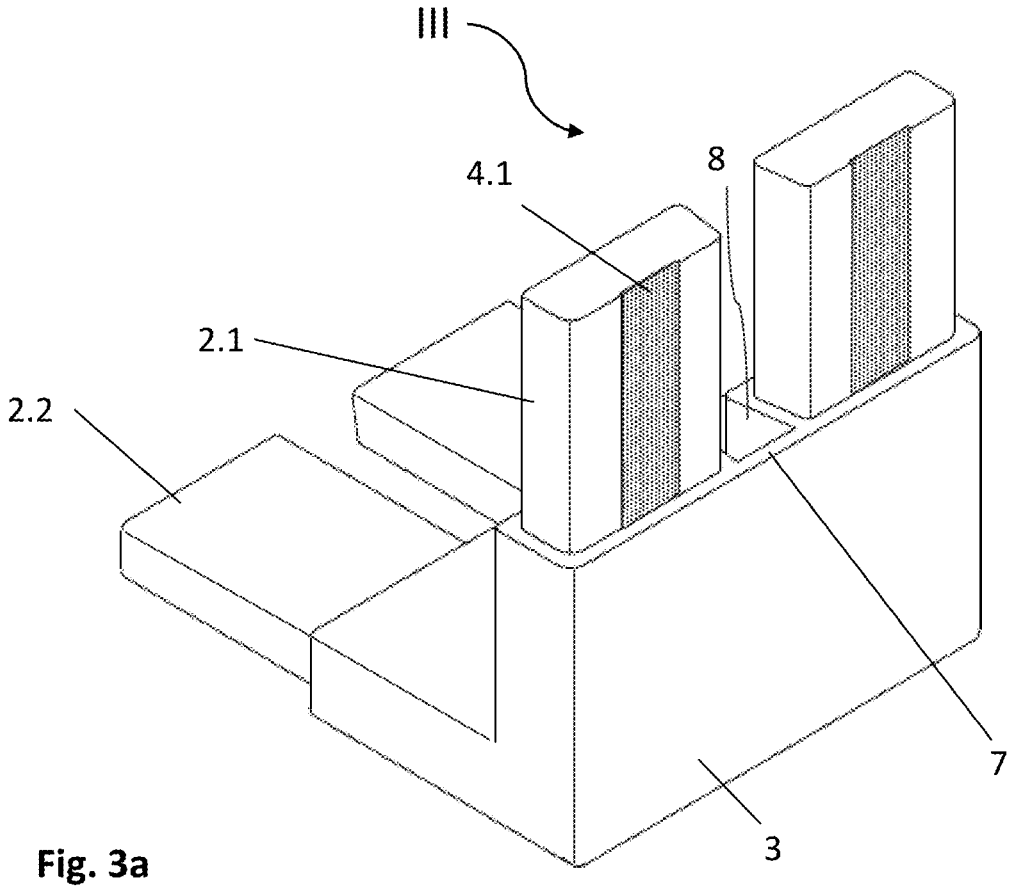
Figure 3B:
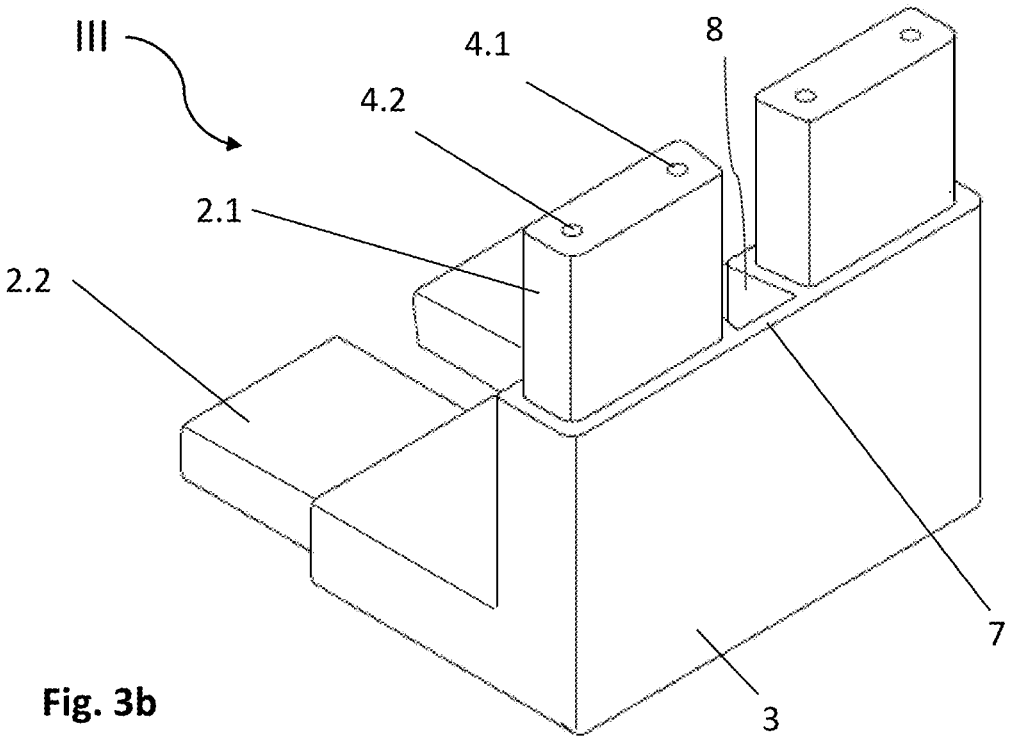
Figure 4:
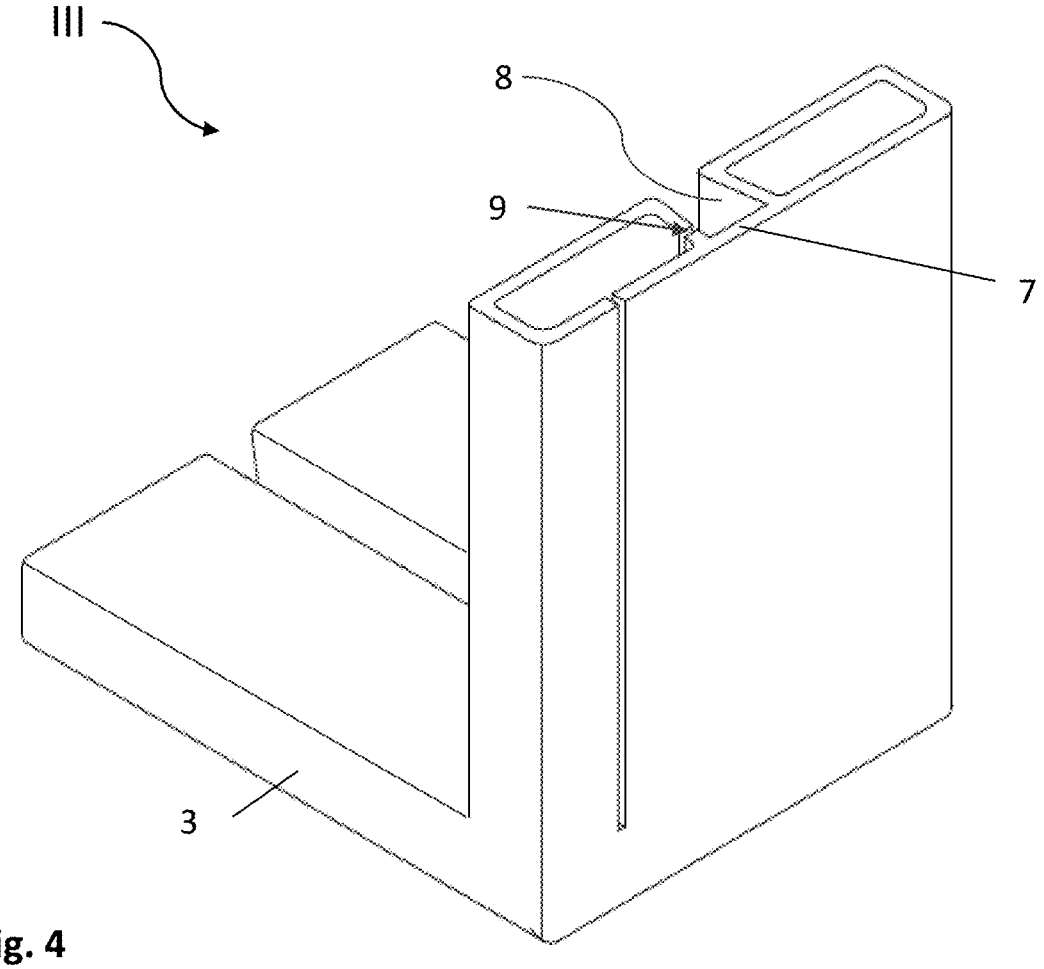
Figure 5:
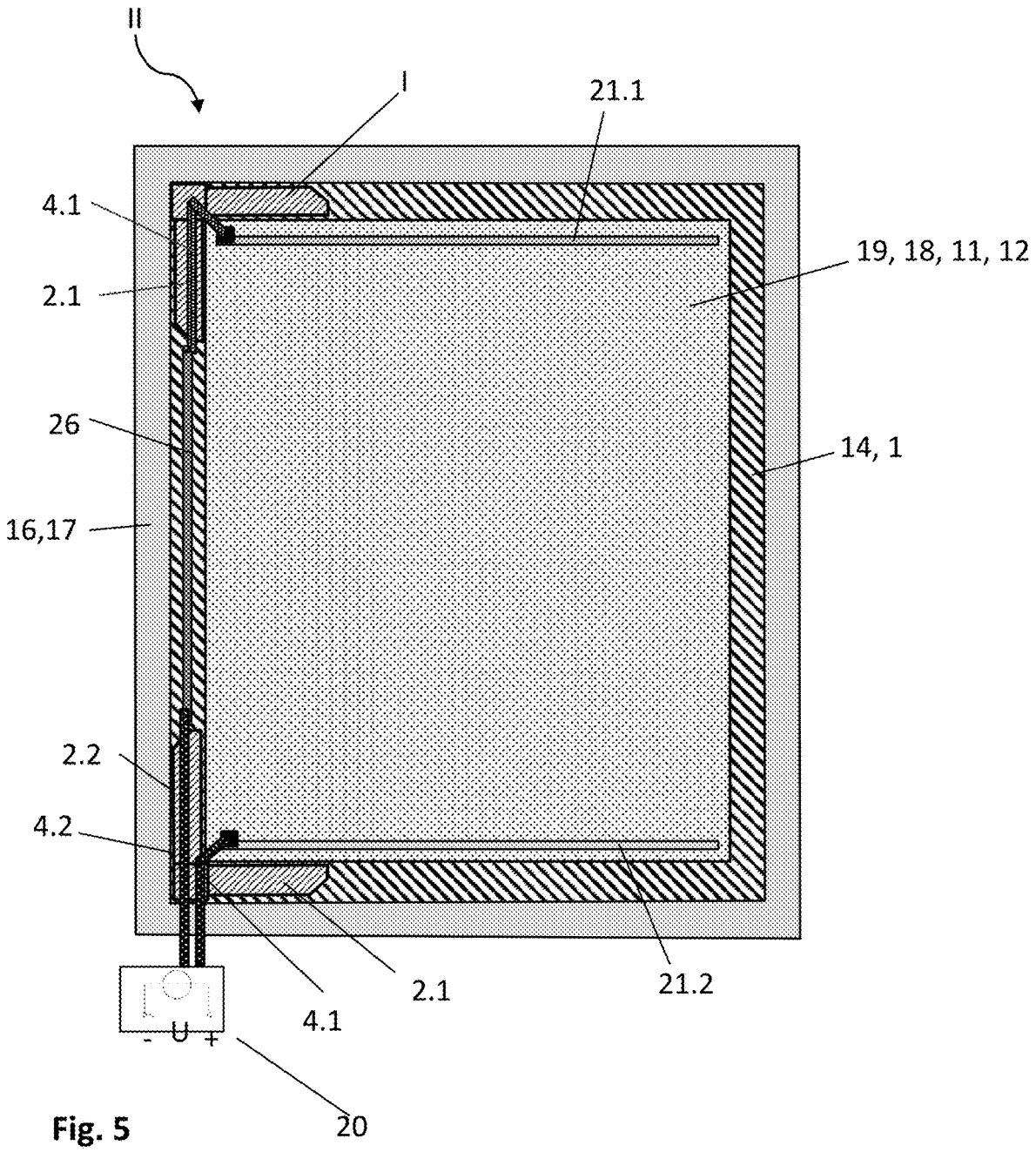
Figure 6:
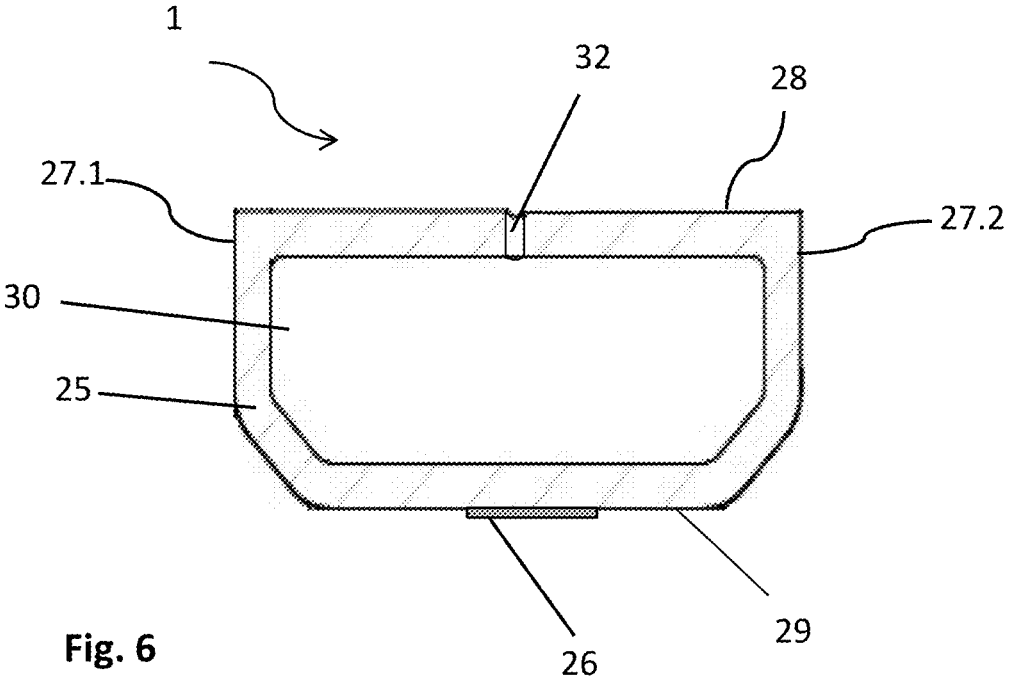
Figure 7:
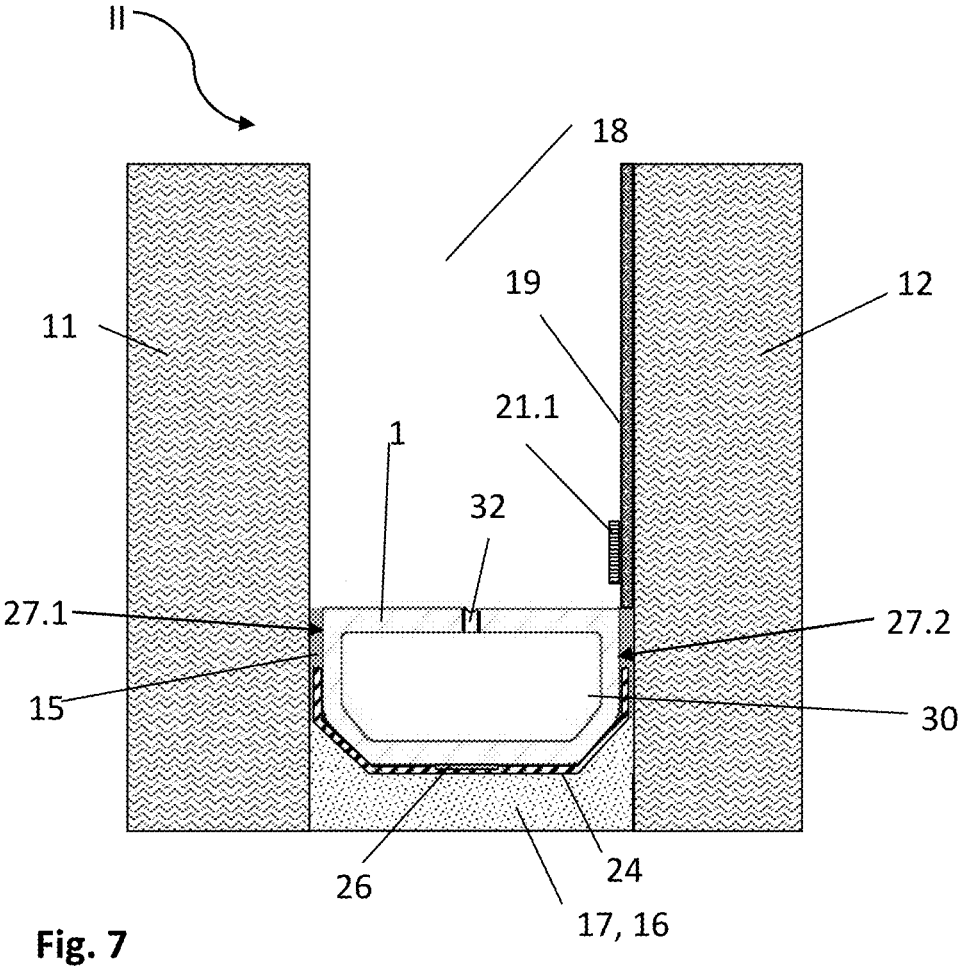

The invention is explained in detail in the following with reference to drawings. The drawings are purely schematic representations and not to scale. They in no way restrict the invention. They depict:

FIG. 1*a* a schematic representation of a corner connector according to the invention in plan view, FIG. 1*b* a schematic representation of a corner connector according to the invention in cross-section, FIG. 1*c* a schematic representation of a corner connector according to the invention in plan view, FIGS. 2*a*, 2*b* and 2*c*, in each case, a schematic representation of a corner connector according to the invention in cross-section, FIGS. 3*a* and 3*b*, in each case, a schematic representation of a double corner connector according to the invention in plan view, FIG. 4 a schematic representation of a part of a double corner connector according to the invention in plan view, FIG. 5 a schematic representation of an insulating glazing unit according to the invention in cross-section, FIG. 6 a schematic representation of a hollow profile spacer for use in an insulating glazing unit according to the invention, and FIG. 7 a schematic representation of an insulating glazing unit according to the invention in the edge region in cross-section.

FIGS. 1*a* and 1*b* depict the same corner connector according to the invention in different views. The representation is greatly simplified. Slats or retaining elements, as they are used in the prior art to fix the corner connectors in a hollow profile strip, are, for example, not shown. These can be added by the person skilled in the art as needed. The corner connector I has a first leg 2.1 and a second leg 2.2, joined to one another via a corner region 3. The first leg 2.1 and the second leg 2.2 enclose an angle $\alpha$ von 90°. The two legs 2.1 and 2.2 and the corner region 3 form the main body 6 and are produced in one piece from a polyamide in an injection molding process. A first electrical supply line 4.1 is integrated in the corner region 3 and in the first leg 2.1. This had already been integrated there during production of the corner connector. Since the main body 6 is made of an electrically insulating polymer, there is no need to provide the electrical supply line 4.1 with sheathing. In the example, this is a simple copper conductor. The first electrical supply line 4.1 protrudes out of the corner region 3. The first electrical supply line 4.1 enters the corner connector in the corner region 3 of the corner connector I, runs along the first leg 2.1, is angled in the corner region 3, and exits again at the end face 5.1 of the first leg 2.1. The first electrical supply line 4.1 enters in the region of the corner region 3 that points toward the outer interpane space in the finished insulating glazing unit such that the first electrical supply line 4.1 makes contact there with the secondary sealant, but does not come into contact with the primary sealant. The dimensions of the corner connector I depend on the hollow profile spacer 1 used. In the example, the length L of a leg is 3.0 cm, and the length E of the corner region is approx. 0.7 cm. The two legs 2.1 and 2.2 are the same length. The corner region 3 protrudes compared to the legs 2.1 and 2.2 such that a hollow profile spacer 1 that is pushed onto one leg 2.1 or 2.2 and rests against the corner region 3 ends flush with the corner region 3.

FIG. 1*c* depicts another corner connector I according to the invention, essentially constructed like that previously depicted. It differs in the structure of the corner region 3, which has a length E of 2.3 cm with a length L of the legs of 1.5 cm. An advantage of this enlarged corner region 3 is that the regions for the entry opening on the side facing the outer interpane space and for a possible exit opening on the side facing the glazing interior (not shown here) are larger. Thus, for example, an exit opening with the possibility of contact can also be arranged in such an enlarged corner region.

FIG. 2*a* depicts another corner connector according to the invention in cross-section. The structure is essentially the same as in FIG. 1*a,b*. It differs by the routing of the first electrical supply line 4.1. In this case, the first electrical supply line 4.1 is a conductor with multiple wires. The first electrical supply line 4.1 enters the corner region 3 in an entry opening and then branches into the corner region 3 and runs through the first leg 2.1 and exits again there in an end face 5.1. The first electrical supply line also runs through the second leg 2.2 and exits again there in an end face 5.2. Since it is a conductor with multiple wires, branching in the corner region 3 is possible. The individual wires are insulated from one another and surrounded by sheathing. With the help of the corner connector I, electrically switchable functional elements can make contact at two different points of the insulating glazing unit, while requiring only a single electrical supply line that is already integrated into a prefabricated corner connector.

FIG. 2*b* depicts another corner connector I according to the invention. The corner connector has a polymeric main body 6 made of polyamide. The corner connector I contains a first electrical supply line 4.1 that runs as described for FIG. 1*a*. In addition, the corner connector contains a second electrical supply line 4.2, which protrudes out of the corner region in each case in the direction of the glazing interior and in the direction of the outer interpane space. Thus, with the help of the corner connector I according to the invention, contact can be made via the second electrical supply line 4.2 of an electrically switchable functional element in the region of the corner of the insulating glazing unit. Moreover, another electrical functional element or the same electrical functional element can be contacted at a more distant location using the first electrical supply line 4.1.

FIG. 2*c* depicts another corner connector according to the invention, constructed essentially like that depicted in FIG. 1*a,b*. The corner connector contains a first electrical supply line 4.1, that protrudes out of the first leg 5.1, is angled in the corner region 3, and also protrudes out of the second leg 5.2. The corner connector according to the invention thus enables routing an electrical supply line around the corner, and thus prevents having to first route a conductor around the corner and then having to again route it into the glazing interior through the sealing of the edge seal.

FIG. 3*a* depicts a double corner connector III according to the invention, which comprises two single corner connectors I according to the invention that are joined to one another in the corner region 3 via a web 7. The web forms a groove 8 for receiving a pane. Such a corner connector is suitable for connecting two double spacers, having two hollow chambers in each case, into which the legs 2.1 and 2.2 of the double corner connector III are pushed. The two first legs 2.1 and the two second leg 2.2 contain in each case a flat conductor as a first electrical supply line 4.1. The flat conductors protrude out of the legs 2.1 and 2.2, in other words, they are freely accessible on the outside of the legs such that upon insertion into a suitable hollow profile spacer, which is, for example, also equipped with a flat conductor, they can establish an electrically conductive connection with this flat conductor. Using the corner connector III depicted, an electrical supply line can be routed around the corner of an insulating glazing unit without having to subsequently route complex cabling through the outer interpane space. A particular advantage of the double corner connector with two first electrical supply lines that lead into separated hollow chambers is that different electrically switchable functional elements can be contacted in different glazing interiors or different polarities can be routed separately from one another into the hollow chambers of a double spacer.

FIG. 3*b* depicts another double corner connector III according to the invention, which comprises two individual corner connectors according to the invention, joined to one another via a web 7, wherein the web is implemented such that it forms a groove 8. The two first legs 2.1 include in each case a first supply line 4.1 and a second supply line 4.2, which are in each case incorporated into the main body of the double corner connector during its production by a metal conductor in the form of a copper wire. The supply lines protrude out of the legs and extend beyond the main body of the double corner connector by approx. 1 to 2 cm (not shown here) in order to implement a connection with an electrical element in the hollow chambers of a double spacer.

FIGS. 3*a* and 3*b* depict in each case symmetrical embodiments of the double corner connector. This is just one selection. Two different corner connectors I according to the invention can also be joined to form a double corner connector according to the invention. Alternatively, the connection of a corner connector I according to the invention with a prior art corner connector without an electrical supply line to form a double corner connector is also possible.

FIG. 4 depicts a part of another embodiment of a double corner connector III according to the invention. In contrast to the one-piece embodiments of legs 2.1, 2.2 and the corner region 3, depicted in FIGS. 1 to 3, here, a two-piece embodiment is provided. In the corner region illustrated, longitudinal connectors are inserted in each case into the hollow chambers such that the legs 2.1 and 2.2 (not shown) are part of a second component. The corner regions 3 of the individual corner connectors are connected via a web 7, which forms a groove 8. In a side plank of the groove 8, a recess 9 is arranged, through which an electrical supply line can be guided from a hollow chamber of the corner region into the groove 8. The electrical supply line can enter the hollow chamber via an entry opening into the wall of the hollow chamber that faces in the direction of the outer interpane space. Alternatively, it is possible to route an electrical supply line directly over the bottom surface of the groove, i.e., through the web 7 into the groove 8. The routing of the electrical supply line in the groove 8 has the advantage that direct contact can be made with an electrically switchable functional element in the groove 8.

FIG. 5 depicts an overall view of an insulating glazing unit I according to the invention. The insulating glazing unit II comprises a spacer frame 14 that comprises two hollow profile spacers 1 and two corner connectors I according to the invention. A first hollow profile spacer 1 is bent twice and runs along three sides the insulating glazing unit. A second hollow profile spacer 1 runs along the fourth side of the insulating glazing unit. The two hollow profile spacers are joined at two corners of the insulating glazing unit II via corner connectors. The spacer frame 14 is arranged between a first pane 11 and a second pane 12. An electrically switchable functional element 19 that is provided with two busbars 21.1 and 21.2 is arranged in the glazing interior 18. The first busbar 21.1 is connected to a first electrical supply line that is arranged in a corner connector I according to the invention. The first electrical supply line 4.1 exits the corner connector and enters the glazing interior. There, it makes electrically conductive contact with the first busbar 21.1. The first electrical supply line 4.1 protrudes out of the first leg 2.1 of the corner connector and enters a hollow chamber of the hollow profile spacer 1. There, the first electrical supply line makes contact with an electrical conductor 26 within the hollow chamber of the hollow profile spacer 1. The electrical conductor 26 runs along the entire fourth hollow profile spacer all the way to a second corner connector I according to the invention, and makes contact there with a second electrical supply line 4.2. The second electrical supply line 4.2 protrudes out of the second leg 2.2 of the corner connector and is connected to a voltage source 20, which is arranged outside the insulating glazing unit. The second electrical supply line 4.2 runs through the secondary sealant 16 in the outer interpane space 17 and enters the corner region in the corner connector I. The second busbar 21.2 is contacted by a first electrical supply line 4.1, which is likewise connected to the voltage source 20 and which enters the corner region in the corner connector and, in the corner region, also exits the corner connector into the glazing interior. There, the first electrical supply line makes contact with the second busbar 21.2. Here, the voltage source is a DC voltage source for operating an electrochromic functional element. The supply lines 4.1 and 4.2 are connected to different poles of the voltage source such that a potential difference is created between the two opposing busbars 21.1 and 21.2. The voltage applied to the busbars 21.1 and 21.2 causes ion migration within the active layer of the electrochromic functional element, influencing its transmittance.

FIG. 6 depicts a schematic representation in cross-section of a hollow profile spacer 1 suitable for an insulating glazing unit according to the invention. The hollow profile spacer 1 includes a polymeric main body 25 and an electrical element 26 in the form of a ribbon conductor on the main body 25. The polymeric main body 25 is a hollow body profile comprising two pane contact surfaces 27.1 and 27.2, a glazing interior surface 28, an outer surface 29, and a hollow chamber 30. The polymeric main body 25 contains styrene acrylonitrile (SAN) and approx. 35 wt.-% glass fiber. The hollow body 30 is usually filled with a desiccant (not shown). The glazing interior surface 28 of the spacer 1 has openings 32, made at regular intervals circumferentially along the glazing interior surface 28 to enable gas exchange between the interior of the insulating glazing unit and the hollow chamber 30. Thus, any atmospheric moisture present in the interior is absorbed by the desiccant. A barrier film (not shown) that reduces the penetration of moisture through the polymeric main body 25 into the glazing interior is applied on the outer surface 29 of the spacer 1. The barrier film usually comprises a film made of polymeric and metallic layers. The polymeric main body 25 is non-conductive for electrical current such that the ribbon conductor 26 does not necessarily have electrical insulation. Preferably, however, the ribbon cable 26 is surrounded by an insulating sheathing or covered by a barrier film with polymeric layers. The ribbon conductor protrudes out of the main body 25 of the spacer at the open cross-sections. There are various possibilities for making an electrically conductive connection to a corner connector I according to the invention. With the variants depicted in FIG. 1, which have a first electrical supply line in each case, which protrudes out of and beyond one leg, the electrical supply line 4.1 has to be brought into contact with the ribbon cable 26 in the form of a cable. For this, the ribbon cable 26 preferably has a part, for example, 1 cm long, placed around the outside wall 29 such that it is routed there for this part in the hollow chamber 30 of the spacer. When the ribbon cable 26 is situated within the hollow chamber, it is obviously not necessary to fold the ribbon cable over. Any insulating sheathing of the first electrical supply line 4.1 and of the ribbon cable 26 should be removed. Then, contact can be established between an electrical element 26 and a first electrical supply line 4.1 by simple insertion of the corner connector I according to the invention into the hollow chamber 30 of the spacer 1. FIG. 3*a* depicts, in the design of a double corner connector Ill, a corner connector with a flat conductor 4.1, which can be electrically conductively connected, by simple insertion into a spacer 1 shown, to a flat conductor 26 folded at the end of the hollow profile spacer in the hollow chamber 30 of the hollow profile.

FIG. 7 depicts a cross-section through an insulating glazing unit II according to the invention with a hollow profile spacer 1 per FIG. 6 with an additional barrier film 24. A spacer frame 14 comprising the hollow profile spacer 1 is mounted circumferentially between a first pane 11 and a second pane 12 via a primary sealant 15. The primary sealant 15 connects the pane contact surfaces 27.1 and 27.2 of the hollow profile spacer 1 to the panes 11 and 12. The glazing interior 18 adjacent the glazing interior surface 28 of the spacer 1 is defined as the space delimited by the panes 11, 12 and the spacer I. The outer interpane space 17 adjacent the outer surface 29 of the spacer 1 is a strip-shaped circumferential section of the glazing that is delimited on one side each by the two panes 11, 12 and on another side by the spacer frame 14 and whose fourth side is open. The glazing interior 18 is, for example, filled with argon. Between a pane contact surface 27.1 or 27.2 and the adjacent pane 11 or 12, respectively, a primary sealant 15 that seals the gap between pane 11, 12 and spacer 1 is introduced. The primary sealant 15 is polyisobutylene. A secondary sealant 16 that serves to bond the first pane 11 and the second pane 12 is applied in the outer interpane space 17 on the outer surface 29. The secondary sealant 16 is made of silicone. The secondary sealant 16 ends flush with the pane edges of the first pane 11 and the second pane 12. On the pane surface directed toward the glazing interior 18, the second pane 12 has an electrically switchable functional element 19 that is equipped with a first first busbar 21.1 for electrically contacting the functional element 19. The electrically switchable functional element 19 is an electrochromic layer.

LIST OF REFERENCE CHARACTERS

I corner connector
II insulating glazing unit
III double corner connector
1 hollow profile spacer
2.1 first leg; first insertion leg
2.2 second leg; first insertion leg
3 corner region
4.1 first electrical supply line
4.2 second electrical supply line
5.1 end face of the first leg
5.2 end face of the second leg
6 main body of the corner connector
7 web
8 groove
9 exit opening
11 first pane
12 second pane
13 third pane

14 spacer frame
15 primary sealant
16 secondary sealant
17 outer interpane space
18 glazing interior
19 electrically switchable functional element
20 external power source, voltage source
21.1 first conductor surface/busbar
21.2 second conductor surface/busbar
25 main body of the hollow profile spacer
26 electrical element in/on the hollow profile spacer
27.1, 27.2 pane contact surfaces of the hollow profile spacer
28 glazing interior surface of the spacer
29 outer surface of the spacer
30 hollow chamber of the spacer
32 openings in the glazing interior surface of the spacer
L length of a leg
E height/length of the corner region

The invention claimed is:

1. A double corner connector comprising two corner connectors, each corner connector being configured for connecting two hollow profile spacers of insulating glazing units, each corner connector comprising a first leg and a second leg, which are connected to one another via a corner region, and a first electrical supply line, wherein the double corner connector includes a polymeric main body, wherein the first electrical supply line is integrated within a material of the polymeric main body, and wherein the first leg and the second leg enclose an angle $\alpha$, where $45° < \alpha < 120°$, the first leg, the second leg, and the corner region are formed in one piece, at least the corner region comprises the first electrical supply line, and the first electrical supply line protrudes out of the corner region from an external surface of the corner region that is outside a portion of the corner region enclosed by said angle $\alpha$, wherein the two corner connectors are connected to each other in the corner region via a web, with the web being implemented such that a groove for receiving a pane is formed between the two corner connectors and the web forming a bottom surface of the groove, and wherein the two corner connectors and the web are formed in one piece, and wherein (a) the polymeric main body is extruded around the first electrical supply line to integrate the first electrical supply line within said material or (b) the first electrical supply line is integrated within the material of the polymeric main body during injection molding of the double corner connector.

2. The double corner connector according to claim 1, wherein, in each corner connector, at least the corner region and the first leg comprise the first electrical supply line, and the first electrical supply line protrudes out of the first leg.

3. The double corner connector according to claim 1, wherein, in each corner connector, the first electrical supply line protrudes only out of the first leg and out of the corner region.

4. The double corner connector according to claim 1, wherein, in each corner connector, the first electrical supply line protrudes out of the first leg and the second leg.

5. The double corner connector according to claim 1, wherein each corner connector comprises one second electrical supply line.

6. The double corner connector according to claim 1, wherein, in each corner connector, the first electrical supply line enters the groove through an exit opening.

7. A method comprising utilizing a double corner connector according to claim 1 in an insulating glazing unit including an electrically switchable functional element.

8. The method according to claim 7, wherein the insulating glazing unit includes an SPD, a PDLC, an electrochromic, or an electroluminescent functional element.

9. The double corner connector according to claim 1, wherein the first electrical supply line integrated within a material of the polymeric main body is devoid of sheathing.

10. An insulating glazing unit comprising a first pane, a second pane, and a third pane, a circumferentially arranged spacer frame between the first pane and the second pane, comprising a double spacer having a groove, and a double corner connector according to claim 1, wherein the first pane and the second pane are connected in a leakproof manner to the spacer frame via a primary sealant, a secondary sealant is arranged in an outer interpane space between the first pane, the second pane, and the spacer frame, the groove of the double spacer and the groove of the double corner connector form a circumferential groove, into which the third pane is inserted, the third pane includes an electrically switchable functional element and the first electrical supply line makes electrically conductive contact with the electrically switchable functional element, and the first electrical supply line protrudes exclusively through the secondary sealant.

11. The insulating glazing unit according to claim 10, wherein the first electrical supply line makes electrically conductive contact in the groove with the electrically switchable functional element.

12. A double corner connector consisting of two corner connectors that are connected to each other in a corner region via a web, each corner connector being configured for connecting two hollow profile spacers of insulating glazing units, each corner connector comprising a first leg and a second leg, which are connected to one another via the corner region, and a first electrical supply line, wherein the double corner connector has a polymeric main body that forms the two corner connectors, wherein the first electrical supply line is integrated within a material of the polymeric main body, and wherein the first leg and the second leg enclose an angle $\alpha$, where $45° < \alpha < 120°$, the first leg, the second leg, and the corner region are formed in one piece, at least the corner region comprises the first electrical supply line, and the first electrical supply line protrudes out of the corner region, and wherein the web is implemented such that a groove for receiving a pane is formed between the two corner connectors and the web forming a bottom surface of the groove, and wherein the two corner connectors and the web are formed in one piece, and wherein (a) the polymeric main body is extruded around the first electrical supply line to integrate the first electrical supply line within said material or (b) the first electrical supply line is integrated within the material of the polymeric main body during injection molding of the double corner connector.

* * * * *